US006437270B1

(12) United States Patent
Morrison et al.

(10) Patent No.: US 6,437,270 B1
(45) Date of Patent: Aug. 20, 2002

(54) PUSHBUTTON SWITCH

(75) Inventors: Scott A. Morrison, Fenton; Daniel C. Murphy, Waterford, both of MI (US)

(73) Assignee: TRW Inc., Lyndhurst, OH (US)

( * ) Notice: Subject to any disclaimer, the term of this patent is extended or adjusted under 35 U.S.C. 154(b) by 132 days.

(21) Appl. No.: 09/661,676

(22) Filed: Sep. 14, 2000

(51) Int. Cl.[7] ..... H01H 13/14
(52) U.S. Cl. ..... 200/520; 200/523
(58) Field of Search ..... 200/520, 523, 200/526, 537, 570, 329, 341; 335/132

(56) References Cited

U.S. PATENT DOCUMENTS 4,230,921 A * 10/1980 Wearing et al. ..... 200/153 J
4,319,106 A * 3/1982 Armitage ..... 200/153 J
4,933,523 A * 6/1990 Honda et al.
5,089,678 A * 2/1992 Zemp et al.
5,296,826 A * 3/1994 Hart et al.
5,420,387 A * 5/1995 Cummings ..... 200/524
5,584,384 A * 12/1996 Mizuno et al. ..... 200/524
5,720,379 A * 2/1998 Schwartz et al. ..... 200/318.1

* cited by examiner

*Primary Examiner*—P. Austin Bradley
*Assistant Examiner*—Lisa N Klaus
(74) *Attorney, Agent, or Firm*—Tarolli, Sundheim, Covell, Tummino & Szabo L.L.P.

(57) ABSTRACT

An electrical switch (10) comprises switch contacts (100, 104) having a closed condition and an open condition. The switch (10) comprises an actuator (40) movable in a first direction (110) in a first stroke to close the contacts (100, 104) and movable in the first direction in a second stroke to cause the contacts to open. A rotatable bar (70) is carried by the actuator (40). The switch (10) includes a mechanism (14, 94, 96) for rotating the bar (70) in response to movement of the actuator (40) in the first direction (110) in the first stroke, to locate the bar in a latching position to hold the contacts (100, 104) in the closed condition. The mechanism (14, 94, 96) also rotates the bar (70) in response to movement of the actuator (40) in the first direction (110) in the second stroke, to move the bar from the latching position and to cause the contacts (100, 104) to open.

12 Claims, 3 Drawing Sheets

PUSHBUTTON SWITCH

BACKGROUND OF THE INVENTION

1. Technical Field

The present invention relates to a pushbutton switch, and is particularly directed to a two position pushbutton switch.

2. Description of the Prior Art

Two position pushbutton switches are used in many applications. One such application is a so-called "window lockout" switch in an automobile. The window lockout switch is typically mounted in an arm rest panel near the driver of the automobile. The window lockout switch is manually depressible to toggle between two axial positions. In one axial position, the window lockout switch electrically disables the rocker switches that the passengers would normally use to operate the automobile's power windows. In the other axial position, the window lockout switch electrically enables the rocker switches adjacent each of the passenger windows so that the passengers can operate the respective power window adjacent their seat in the automobile.

SUMMARY OF THE INVENTION

The present invention is an electrical switch comprising switch contacts having a closed condition and an open condition. The switch comprises an actuator movable in a first direction in a first stroke to close the contacts and movable in the first direction in a second stroke to cause the contacts to open. A rotatable bar is carried by the actuator. The switch includes a mechanism for rotating the bar in response to movement of the actuator in the first direction in the first stroke, to locate the bar in a latching position to hold the contacts in the closed condition. The mechanism also rotates the bar in response to movement of the actuator in the first direction in the second stroke, to move the bar from the latching position and to cause the contacts to open.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF AN EMBODIMENT

Figure 1:
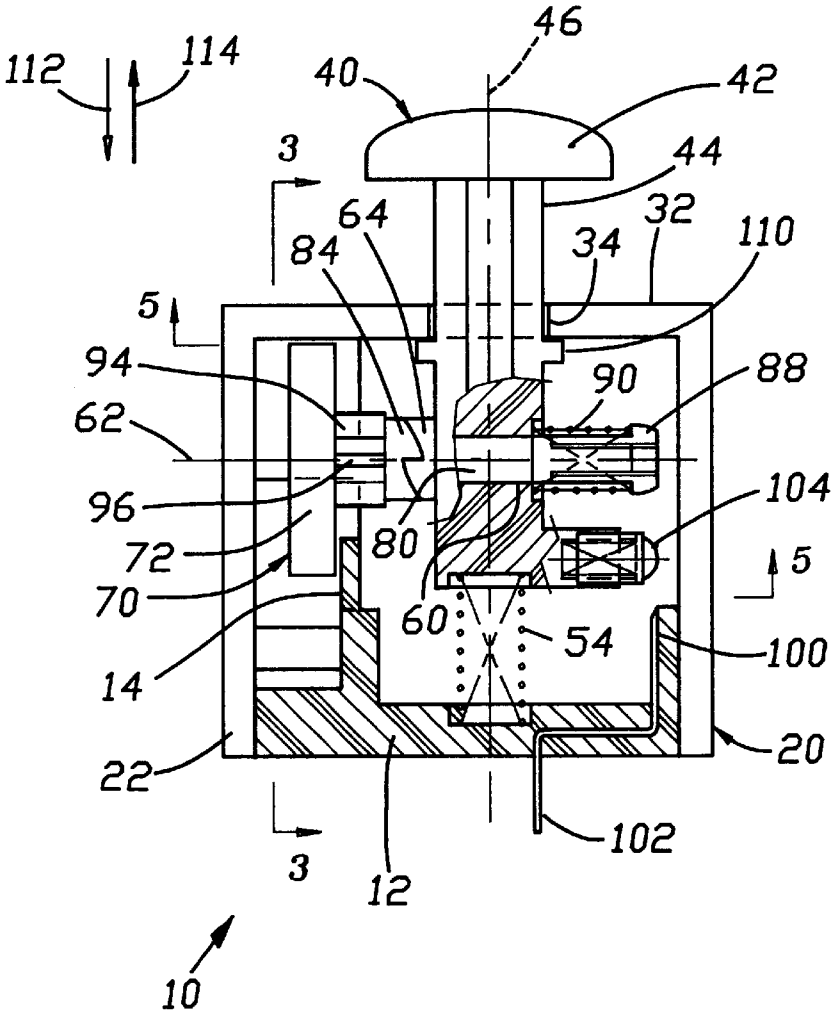
FIG. 1 is a side elevational view, partly in section, of a pushbutton switch constructed in accordance with the present invention, with electrical contacts shown in an open condition.

The present invention relates to a pushbutton switch, and is particularly directed to a two position pushbutton switch, such as a power window lockout switch for a vehicle. The present invention is applicable to various switch constructions. As representative of a preferred embodiment of the present invention, FIG. 1 illustrates a two position pushbutton switch 10.

The switch 10 includes a base 12. The base 12 is made from an electrically insulating material, preferably plastic, such as ABS or polycarbonate. The base 12 has a generally rectangular configuration. An internal rib 14 on the base 12 projects upwardly from the base.

The switch 10 also includes a housing 20. The housing 20 is preferably made from the same plastic material as the base. The housing 20 is a box-shaped structure having a generally rectangular configuration that matches the configuration of the base 12. The housing 20 is connected with the base 12 to secure the housing to the base. The joined housing 20 and base 12 together form an enclosure for the switch 10.

The housing 20 includes a front wall 22. The front wall 22 has an upside down U-shaped opening 24. A smaller U-shaped opening, or slot, 26 extends upward from the center of the opening 24. Wall portions 28 and 30 of the front wall 22, on either side of the slot 26, form the upper boundary of the larger U-shaped opening 24.

The housing 20 also includes a top wall 32. The top wall 32 of the housing 20 has a rectangular opening 34. Two small slots 36 extend from opposite sides of the opening 34 in the top wall 32 of the housing 20. The internal rib 14 on the base 12 projects upwardly from the base in a direction toward the top wall 32 of the housing 12.

The switch 10 includes an actuator assembly 38. The actuator assembly 38 includes an actuator 40 and a rotatable bar, or rotor, 70. The actuator 40 in the illustrated embodiment is made as one piece, preferably from the same plastic material as the base 12 and the housing 20. The actuator 40 is an elongate member that extends through the opening 34 in the top wall 32 of the switch 10. A handle or pushbutton 42 is located on the projecting outer end portion of the actuator 40.

A main body portion 44 of the actuator 40 extends from the pushbutton 42 into the housing 20, along a central axis 46 of the switch 10. The main body portion 44 of the actuator 40 has a generally rectangular cross-sectional configuration closely received in the opening 34 in the top wall 32 of the housing 20. The housing 20 supports the actuator 40 for reciprocating movement relative to the housing in directions parallel to the central axis 46 of the switch 10.

Figure 2:
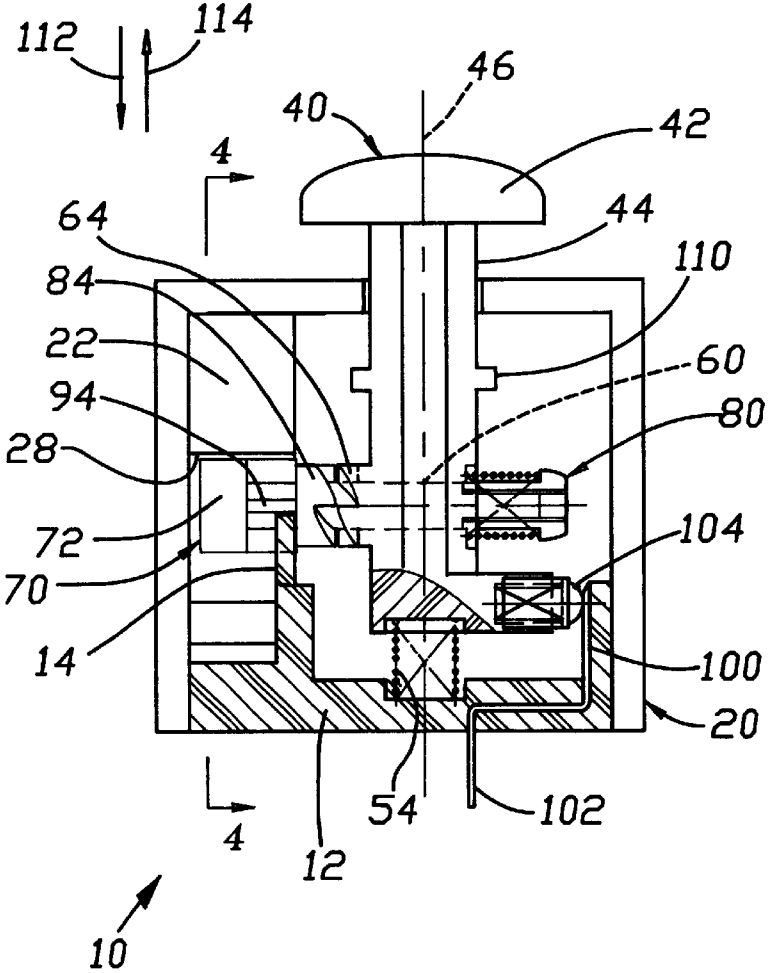
FIG. 2 is a view similar to FIG. 1 showing the switch with the electrical contacts in a closed condition.

An inner end portion 50 of the actuator 40 is disposed adjacent the base 12 of the switch 10. A spring cavity 52 is formed in the inner end portion 50 of the actuator 40. One end of main spring 54 is received in the spring cavity 52. The main spring 54 acts between the base 12 and the actuator 40, in a direction parallel to the central axis 46. The main spring 54 is a compression spring, which biases the actuator 40 in a direction away from the base 12. Stops 110 (FIG. 2) on the actuator 40 limit movement of the actuator away from the base 12.

A pair of locator flanges 56 project radially from opposite sides of the main body portion 44 of the actuator 40. The locator flanges 56 are received in the slots 36 in the top wall 32 of the housing 20. The locator flanges 56 prevent the actuator 40 from rotating relative to the housing 20 about the central axis 46.

A rotor opening 46 is formed in the main body portion 44 of the actuator 40. The rotor opening 60 is a cylindrical opening that extends completely through the actuator 40, at a location inside the housing 20. The rotor opening 60 is centered on an axis of rotation 62. The axis of rotation 62 extends through, and is perpendicular, to the central axis 46 of the switch 10.

A plurality of helical teeth 64 are formed on one side 66 of the main body portion 44 of the actuator 40. The teeth 64 surround one end of the rotor opening 60 in the main body portion 44 of the actuator 40. The teeth 64 are disposed in a circular array centered on the axis of rotation 62. The teeth 64 are presented outward away from the main body portion 44 of the actuator 40.

The rotor 70 in the illustrated embodiment is made as one piece, preferably from the same plastic material as the housing 20 and the actuator 40. The rotor 70 has a planar main body portion 72. The main body portion 72 of the rotor 70 has an oval configuration. The length of the main body portion 72 of the rotor 70, indicated by the dimension 74, is significantly greater than the width of the main body portion of the rotor, indicated by the dimension 76.

A hub portion 80 of the rotor 70 projects from the center of the main body portion 72, in a direction perpendicular to the main body portion. The hub portion 80 of the rotor 70 is configured to support the rotor for rotation on the actuator 40. Specifically, the hub portion 80 of the rotor 70 has a generally cylindrical shape centered on the axis of rotation 62. The axis of rotation 62 is thus an axis of rotation of the rotor 70.

A first part 82 of the hub portion 80 of the rotor 70 is solid. A plurality of helical teeth 84 are formed on the first part 82 of the hub portion 80 of the rotor 70. The teeth 84 are presented away from the main body portion 72 of the rotor 70. The teeth 84 are spaced equally about the axis of rotation 62 of the rotor 70.

A second part 84 of the hub portion 80 of the rotor 70 projects from the first part 82 as a continuation of the first part. The second part 84 is formed as a plurality of fingers 86 that have enlarged end portions 88. The fingers 86 are resiliently movable toward and away from the axis of rotation 62 of the rotor 70. The outer diameter of the group of fingers 86, not including the enlarged end portions 88, is about the same as the diameter of the rotor opening 60 in the actuator 40.

The hub portion 80 of the rotor 70 extends through the rotor opening 60 in the actuator 40. The hub portion 80 supports the rotor 70 for rotation relative to the actuator 40 about the axis of rotation 62. When the rotor 70 is thus supported on the actuator 40, the main body portion 72 of the rotor is on one side of the main body portion 44 of the actuator 40. The enlarged end portions 88 of the fingers 86 of the rotor 70 are on the opposite side of the main body portion 44 of the actuator 40. The hub portion 80 of the rotor 70 is long enough to allow a limited amount of axial movement of the rotor in the rotor opening 60 of the actuator 40. The enlarged end portions 88 of the fingers 86 prevent the rotor 70 from moving axially out of the rotor opening 60.

A compression spring 90 is supported on the hub portion 80 of the rotor 70. The spring 90 acts between the actuator main body portion 44 and the enlarged end portions 88 of the rotor fingers 86. The spring 90 biases the rotor 70 in a direction along its axis of rotation 62 so as to urge the main body portion 72 of the rotor 70 toward the main body portion 44 of the actuator 40. In this condition, the teeth 84 on the rotor 70 are engageable with the teeth 64 on the actuator 40, as described below, to control the rotational position of the rotor relative to the actuator.

A plurality of ribs are formed on the back surface 92 of the main body portion 72 of the rotor 70. In the illustrated embodiment, two pairs of ribs are provided. One pair of ribs 94 are located diametrically opposite each other. The ribs 94 extend radially outward from the first part 82 of the hub portion 80 of the rotor 70. The ribs 94 extend parallel to the length of the main body portion 72 of the rotor 70.

The second pair of ribs 96 are located diametrically opposite each other. The ribs 96 extend radially outward from the first part 82 of the hub portion 80 of the rotor 70. The ribs 96 extend perpendicular to the first pair of ribs 94. Thus, the ribs 96 extend perpendicular to the length of the main body portion 72 of the rotor 70. As a result, the four ribs 94 and 96 are spaced equally 90 degrees apart, about the axis of rotation 62 of the rotor 70.

The switch 10 includes electrical contacts for controlling operation of an electrical device of the vehicle, such as power windows. The contacts include a fixed contact 100 secured to the base 12 and/or housing 20 of the switch 10. The fixed contact 100 is connected, by terminals 102, to vehicle electric circuitry including the electric device to be controlled by the switch 10.

The contacts also includes a movable contact 104. The movable contact 104 is located on a lateral extension 106 of the actuator 40. The movable contact 104 is spring biased on the extension 106. The movable contact 104 is movable into and out of engagement with the fixed contact 100, in response to movement of the actuator 40 in the housing 20.

Figure 3:
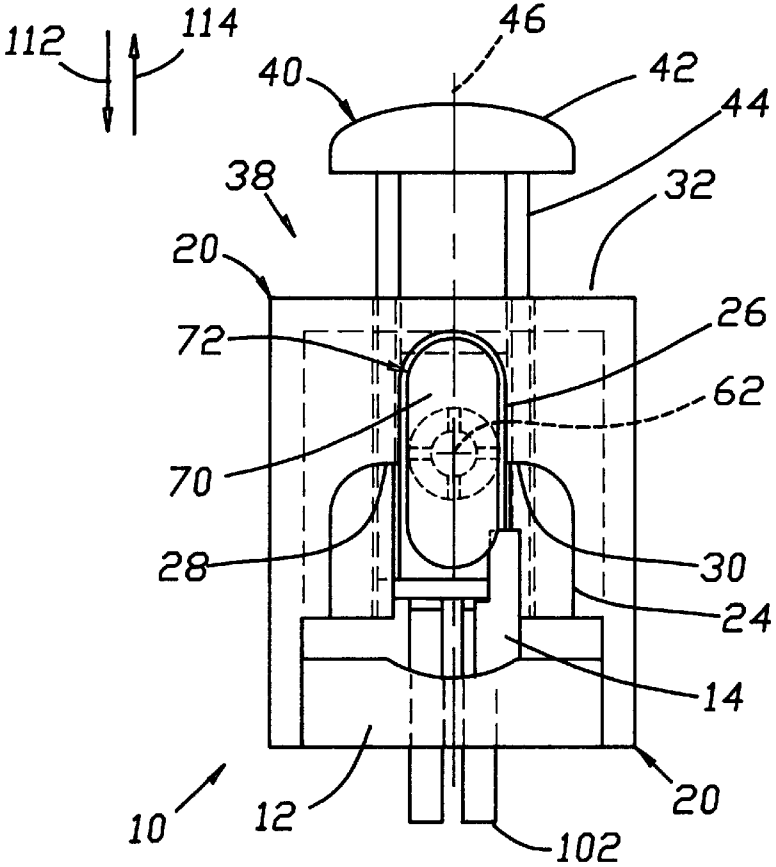
FIG. 3 is a front elevational view of the switch of FIG. 1, taken generally along line 3—3 of FIG. 1.
Figure 5:
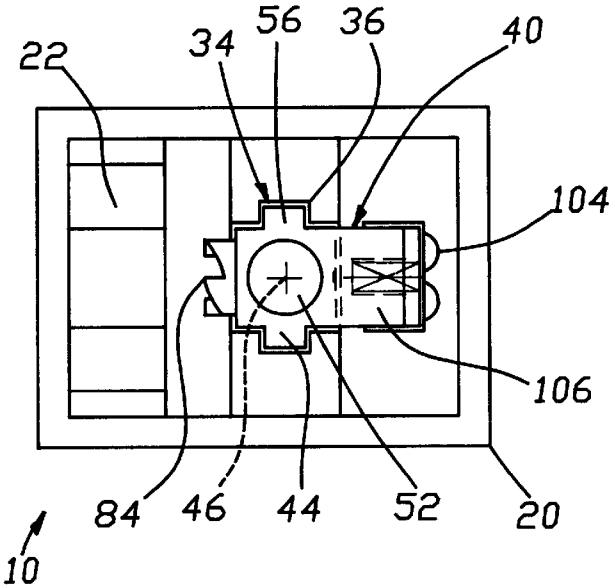
FIG. 5 is a top plan view, partially in section, of the switch of FIG. 1, taken generally along line 5—5 of FIG. 1.
Figure 7:
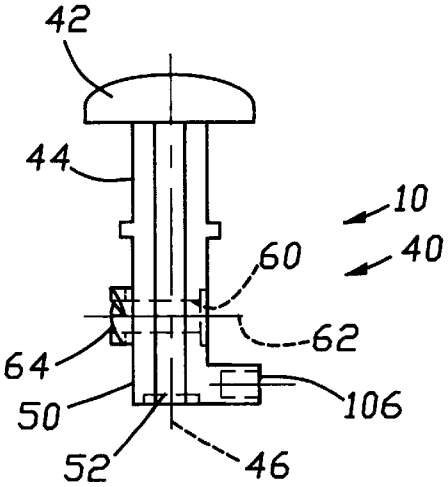
FIG. 7 is a side elevational view of the actuator of FIG. 6.
Figure 6:
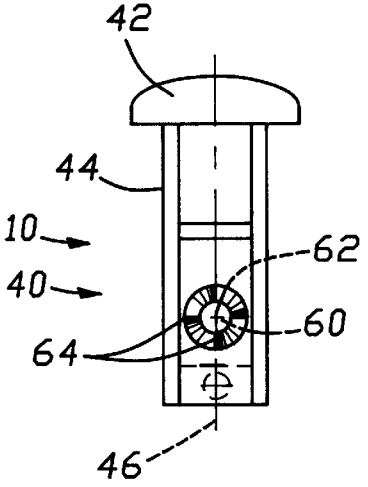
FIG. 6 is a front elevational view of an actuator that forms a part of the switch of FIG. 1.
Figure 10:
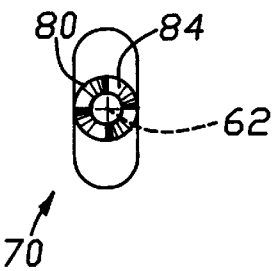
FIG. 10 is a rear elevational view of the rotatable bar of FIG. 8.
Figure 9:
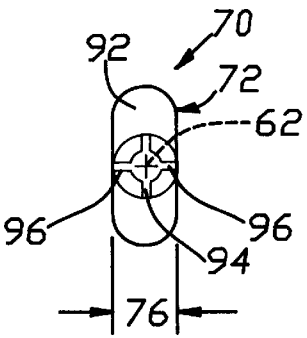
FIG. 9 is a front elevational view of the rotatable bar of FIG. 8.
Figure 8:
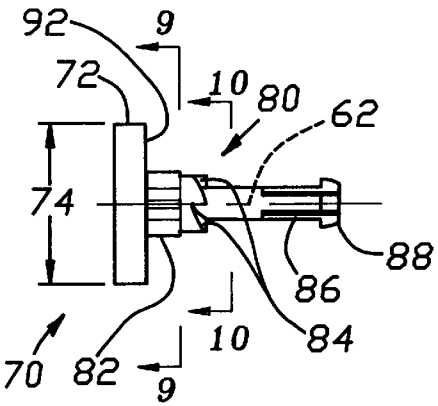
FIG. 8 is a top plan view of a rotatable bar that forms a part of the switch of FIG. 1.

FIGS. 1 and 3 illustrate the switch 10 in a first switch condition. When the switch 10 is in the first switch condition, the main spring 54 biases the actuator 40 into an upward, or outward, position, relative to the housing 20. The stops 110 on the actuator 40 limit such outward movement. The handle 42 is spaced outward from the top wall 32 of the housing 20 by a first distance.

When the switch 10 is in the first switch condition, the rotor 70 is in a non-latching position. When the rotor 70 is in the non-latching position, the main body portion 72 of the rotor is oriented parallel to the central axis 46 of the switch 10, that is, vertically as viewed in FIGS. 1 and 3. The main body portion 72 of the rotor 70 is received in the slot 26 in the front wall 22 of the housing 20. The teeth 84 on the rotor 70 are in engagement with the teeth 64 on the actuator 40. The movable switch contact 104 is spaced apart from the fixed switch contact 100. As a result, the switch contacts 100 and 104 are in an open condition.

When a vehicle occupant depresses the pushbutton 42 with a first stroke, the actuator 40 moves in a first direction 112 along the central axis 46. The actuator 40 moves toward the base 12, compressing the main spring 54. Because the hub portion 80 of the rotor 70 extends through the actuator main body portion 44, the movement of the actuator 40 pushes the rotor 70 toward the base.

The axis 62 of rotation of the rotor 70, and the rotor as a whole, move toward the base 12. The main body portion 72 of the rotor 70 moves out of the slot 26 in the front wall 22 of the housing 20. The movable switch contact 104 moves toward the fixed switch contact 100.

After a predetermined amount of movement of the actuator 40 toward the base 12, the rotor 70 moves adjacent to the projecting rib 14 on the base 12. The rib 14 on the base 12 moves into engagement with one of the ribs 96 on the back surface 94 of the rotor 70. This engagement is at a location spaced apart from the axis of rotation 62 of the rotor 70, that is, at an eccentric location on the rotor.

Figure 4:
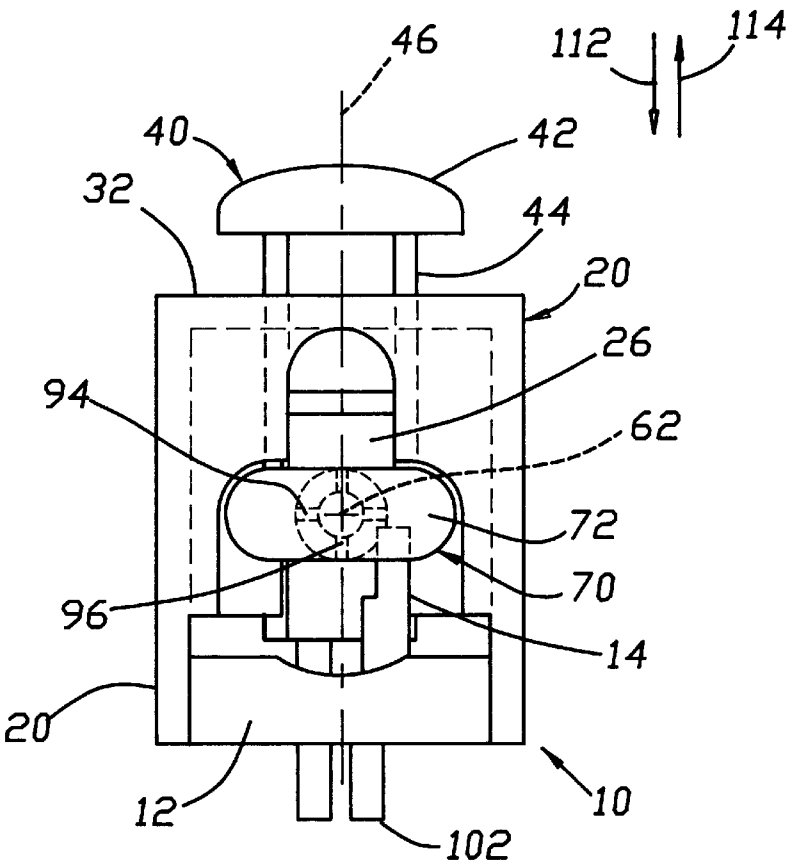
FIG. 4 is a front elevational view of the switch of FIG. 2, taken generally along line 4—4 of FIG. 2.

Continued movement of the actuator 40, and the rotor 70, toward the base 12, causes the base rib 14 to exert a force on the rotor rib 96. This force, acting at an eccentric location on the rotor 70, causes the rotor to begin to rotate about the axis of rotation 62. This rotation occurs while the rotor 70 is moving toward the base 12. The configuration of the interengaging helical teeth 84 and 64 is such that the rotor 70 is able to rotate in only one direction relative to the actuator 40 that is, clockwise as viewed in FIGS. 3 and 4.

As the rotor 70 rotates, the teeth 84 on the rotor 70 interact with the teeth 64 on the actuator 40 and cause the rotor main body portion 72 to move axially, along its axis of rotation 62, in a direction away from the actuator main body portion 44. This axial movement takes place simultaneously with the rotational movement of the rotor 70. This axial movement continues until the rotor 70 has rotated 45 degrees about its axis of rotation 62, and the crests of the teeth 84 on the rotor pass the crests of the teeth 64 on the actuator 40.

At that point in time, the rotor main body portion 72 begins to move axially back toward the actuator main body portion 44, under the influence of the spring. This axial movement continues until the rotor 70 has rotated another 45 degrees about its axis of rotation 62, and the teeth 84 on the rotor fully engage with the teeth 64 on the actuator 40. At that point in time, both the axial and rotational movement of the rotor 70 cease. This position is shown generally in FIG. 2, which, for clarity, shows the rotor teeth 84 spaced axially from the actuator teeth 64.

When the rotation of the rotor 70 thus ceases, the rotor has turned 90 degrees from its initial orientation. The rotor 70 is horizontal as viewed in FIGS. 2 and 4. The rotor 70 is below (as viewed in FIG. 4) the wall portions 28 and 30, that is, between the wall portions and the base 12.

When the vehicle occupant then releases the handle 42, the main spring 54 causes the actuator 40 and the handle to move away from the base 12, in a second direction 114 opposite the first direction 112. This movement continues until the main body portion 72 of the rotor 70 engages the wall portions 28 and 30 of the front wall 22 of the housing 20. This engagement prevents further upward/outward movement of the rotor 70 and the actuator 40. The switch 10 is then in a second switch condition.

When the switch 10 is in the second switch condition, the movable switch contacts 104 are in engagement with the fixed switch contacts 100, and thus the switch contacts are in a closed condition. The electric circuit of which the switch 10 is a part is closed, rather than open. The rotor 70 is in a latching position, holding the switch contacts 100 and 104 in the closed condition. The pushbutton 42 is spaced outward from the top wall 32 of the housing 20 by a second distance, which is less than the first distance.

When it is desired to open the switch contacts 100 and 104, the operator manually depresses the handle 42 again in a second stroke. The actuator 40 moves in the first direction 110. The movement of the actuator 40 carries the rotor 70 toward the base 12, compressing the main spring 52. The main body portion 72 of the rotor 70 moves away from the wall portions 28 and 30 of the front wall 22 of the housing 20.

After a predetermined amount of movement of the actuator 40 toward the base 12, the rotor 70 moves close to the projecting rib 14 on the base 12. The rib 14 on the base 12 moves into engagement with one of the ribs 94 on the back surface of the main body portion 72 of the rotor 70. This engagement is at a location spaced apart from the axis of rotation 62 of the rotor 70, that is, at an eccentric location on the rotor.

Continued movement of the actuator 40, and the rotor 70, toward the base 12, causes the base rib 14 to exert a force on the rotor rib 94. This force, acting at an eccentric location on the rotor 70, causes the rotor to begin to rotate about the axis of rotation 62. This rotation occurs while the rotor 70 is moving toward the base 12. Again, the rotor 70 is able to rotate in only one direction relative to the actuator 40-that is, clockwise as viewed in FIGS. 3 and 4.

As the rotor 70 rotates, it also moves axially, in a direction to move the main body portion 72 away from the actuator main body portion 44. This axial movement continues until the rotor 70 has rotated 45 degrees about its axis of rotation 62. After that point, the rotor main body portion 72 moves axially back toward the actuator main body portion 44, under the influence of the spring 90. This movement continues until the rotor 70 has rotated another 45 degrees about its axis of rotation 62, and the teeth 84 on the rotor 70 fully engage with the teeth 64 on the actuator 40. At that point in time, both the axial and rotational movement of the rotor 70 cease.

When the rotation of the rotor 70 thus ceases, the rotor has turned 90 degrees from its initial orientation. The rotor 70 extends vertically, at a location directly below the slot 26 in the front wall 22 of the housing 20.

When the vehicle occupant then releases the handle 42, the main spring 54 causes the actuator 40 and the handle to move away from the base 12, in the second direction 114 opposite the first direction 110. During this movement, the main body portion 72 of the rotor 70 moves vertically into the slot 26 in the front wall 22 of the housing 20. The engagement of the rotor main body portion 72 in the slot 26 stops upward movement of the rotor 70 and the actuator 40. The switch is then back in the first switch condition. The switch contacts 104 and 100 are in the open condition.

From the above description of the invention, those skilled in the art will perceive improvements, changes and modifications in the invention. Such improvements, changes and modifications within the skill of the art are intended to be covered by the appended claims.

Having described the invention, we claim:

1. An electrical switch comprising:

switch contacts having a closed condition and an open condition;

an actuator movable in a first direction in a first stroke to close said contacts and movable in said first direction in a second stroke to cause said contacts to open;

a rotatable bar carried by said actuator; and a mechanism for rotating said bar in response to movement of said actuator in said first direction in said first stroke to locate said bar in a latching position to hold said contacts in the closed condition and for rotating said bar in response to movement of said actuator in said first direction in said second stroke to move said bar from the latching position and to cause said contacts to open.

2. A switch as set forth in claim 1 wherein said actuator has a manually engageable portion and is manually depressible to effect movement of said actuator in said first direction.

3. A switch as set forth in claim 1 wherein said rotatable bar is rotatable about an axis of rotation that extends transverse to said first direction.

4. A switch as set forth in claim 3 wherein said axis of rotation is defined by said actuator, said axis of rotation and said rotatable bar moving in said first direction with said actuator when said actuator is moved in said first direction.

5. A switch as set forth in claim 4 wherein said mechanism for rotating said bar in response to movement of said actuator in said first direction effects rotation of said bar in a first direction of rotation about said axis of rotation in response to movement of said actuator in said first direction in both of said first and second strokes.

6. A switch as set forth in claim 3 wherein said rotatable bar moves axially along said axis of rotation during rotation of said rotatable bar about said axis of rotation.

7. A switch as set forth in claim 6 wherein said switch contacts comprise at least one movable switch contact on said actuator and movable into engagement with a fixed switch contact.

8. A switch as set forth in claim 1 wherein said rotatable bar is movable between:

a first orientation blocking movement of said actuator in a second direction opposite said first direction, when said rotatable bar is in the latching condition, and a second orientation enabling movement of said actuator in the second direction when said rotatable bar is not in the latching condition.

9. A pushbutton electrical switch comprising:

a housing defining a first axis and supporting electrical switch contacts having a closed condition and an open condition; and an actuator assembly supported on said housing for movement relative to said housing;

said actuator assembly including an actuator member movable axially relative to said housing;

said actuator assembly also including a rotor movable, in response to axial movement of said actuator member, in a direction transverse to said first axis between a latching position holding said contacts in the closed condition and a non-latching position in which said contacts are open;

said actuator assembly toggling between a first switch condition in which said contacts are in the open condition and a second switch condition in which said contacts are closed, in response to successive axial movements of said actuator member relative to said housing.

10. A switch as set forth in claim 9 wherein said actuator member defines a second axis extending transverse to said first axis, said rotor being rotatable about said second axis in response to movement of said actuator member along said first axis.

11. A switch as set forth in claim 10 wherein said axis and said rotor move in said first direction with said actuator member when said actuator member is moved in said first direction.

12. A switch as set forth in claim 9 wherein said rotor moves axially along said second axis during rotation about said second axis.

* * * * *